United States Patent [19]

Lawson

[11] 4,436,126

[45] Mar. 13, 1984

[54] WOOD PLANING MACHINE

[75] Inventor: Peter Lawson, Campinas, Brazil

[73] Assignee: Rockwell Interntional Corporation, Pittsburgh, Pa.

[21] Appl. No.: 303,318

[22] Filed: Sep. 17, 1981

[51] Int. Cl.[3] ..... B27C 1/00

[52] U.S. Cl. ..... 144/130; 144/117 R

[58] Field of Search ..... 144/114 R, 117 R, 116, 144/130, 373

[56] References Cited

U.S. PATENT DOCUMENTS

| | | | |
|---|---|---|---|
| 2,642,902 | 6/1953 | Carey | 144/117 R |
| 2,780,250 | 2/1957 | Leonard | 144/130 |
| 2,873,776 | 2/1959 | Buttke | 144/117 R |

FOREIGN PATENT DOCUMENTS

| | | | |
|---|---|---|---|
| 1382457 | 1/1975 | United Kingdom | 144/130 |

*Primary Examiner*—W. D. Bray

[57] ABSTRACT

There is described a light, portable thicknessing machine for wood, which comprises a base part including a bed (1) over which wood to be thicknessed passes, and an upper housing (9) in which are mounted a cutter and feed rollers to advance the wood, the upper housing being slidingly supported on a number of pillars (4) extending upwardly from the base part (2). At least two oppositely disposed pillars (4) have mounted coaxially therein threaded shafts which engage with lugs fixed to upper housing (9), the lugs passing through longitudinal slots in the pillars (4). The threaded shafts are interconnected so that they rotate together, by means of sprockets at their lower ends engaging an endless chain (6) rotation of the shafts thus effecting vertical movement of the upper housing (9) to adjust the height of the cutter above the bed.

4 Claims, 8 Drawing Figures

FIG. 3
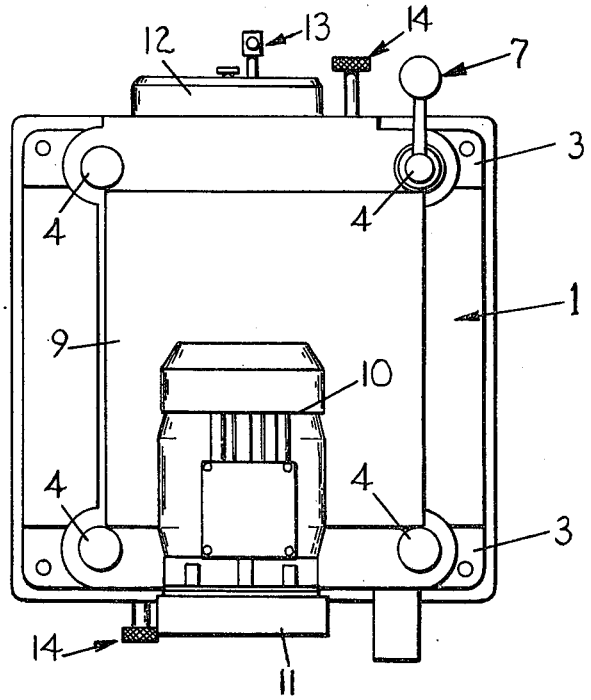
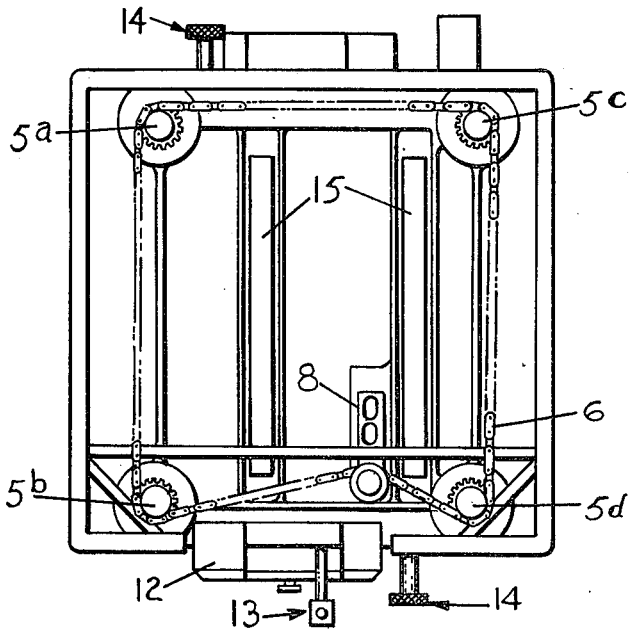
FIG. 4

WOOD PLANING MACHINE

BACKGROUND OF THE INVENTION

The invention concerns a thicknessing machine for wood, and particularly a compact but durable machine which, although portable, will still serve for heavy duty work.

Hitherto, thicknessing machines or planers have been large, cumbersome machines which, once installed, remain in a single location for the duration of their working life. The disadvantages of cutting material to size and subsequently transporting it to the site where it will be used are apparent. With a machine actually on the site, the material can be produced as it is required, thus eliminating waste, and small adjustments to the required size can be simply and quickly effected.

SUMMARY OF THE INVENTION

The present invention provides a compact, light and portable planer which may easily be located at a succession of work sites.

According to the present invention, a thicknessing machine or planar for wood comprises a bed, on which wood to be shaped is slidable, feed rollers to advance the wood at a predetermined rate, a cutter positioned to contact the wood and a motor connected to the cutter and to the feed rollers by a speed reduction means, characterized in that the bed of the machine is fixed and the cutter and feed rollers and their connections to the motor are mounted on a housing which is movably supported above the bed, the housing being capable of movement towards and away from the bed.

BRIEF DESCRIPTION OF THE DRAWINGS

An embodiment of the present invention will now be described with reference to the accompanying drawings in which:

FIG. 3 shows a plan view of the machine;

FIG. 4 shows an underneath view of the machine; and

Figure 1:
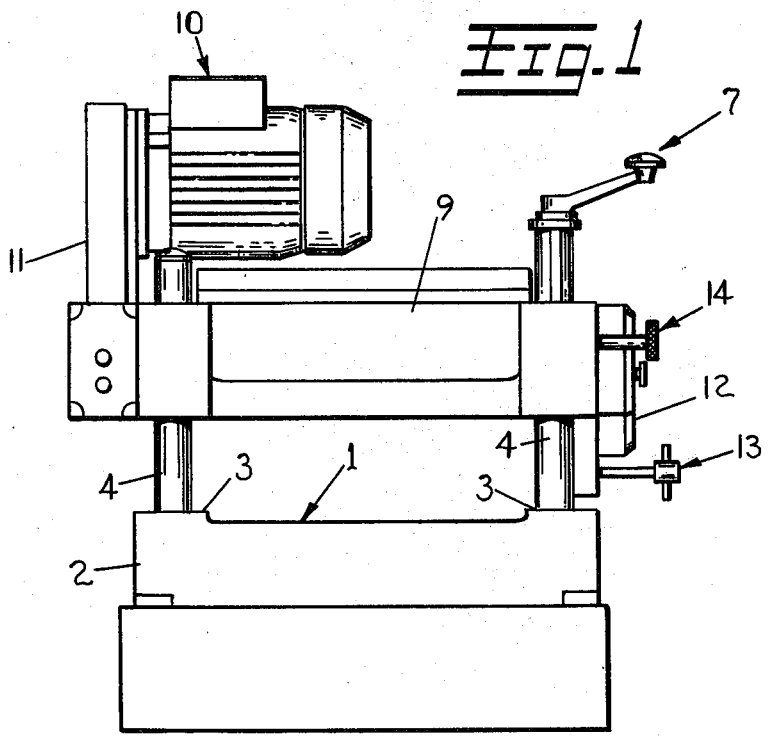
FIG. 1 shows an end view of the machine looking in the direction in which wood is fed into the machine.
Figure 2:
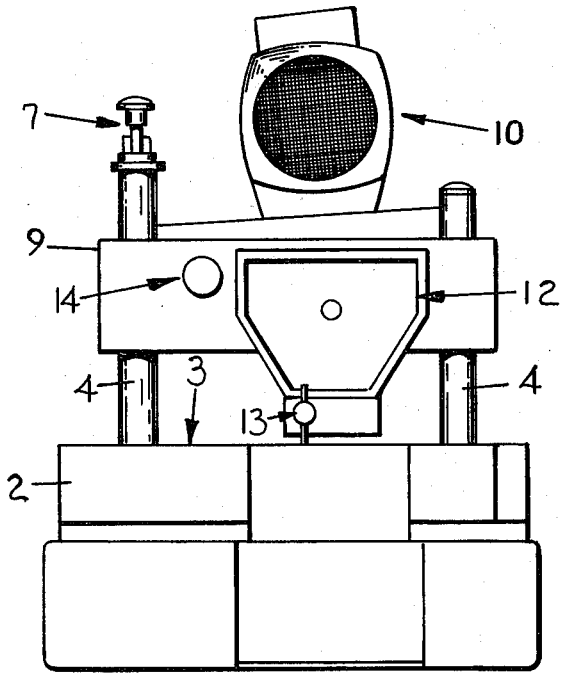
FIG. 2 shows a side view of the machine from the right as seen in FIG. 1.

The thicknessing machine or planer of the present invention comprises a bed 1, over which wood to be shaped is passed. The bed 1 is on the upper surface of a base part 2 of the machine and is bordered on two sides by raised portions 3.

DESCRIPTION OF THE PREFERRED EMBODIMENT

Extending upwardly from the raised portions 3 are four pillars 4, which are hollow and each contain a threaded shaft accessible via a longitudinal slot in the pillar. The upper ends of three of the pillars are closed by end caps, and the upper end of the fourth pillar carries an adjusting handle 7 connected to the threaded shaft 7 in that pillar.

Figure 7:
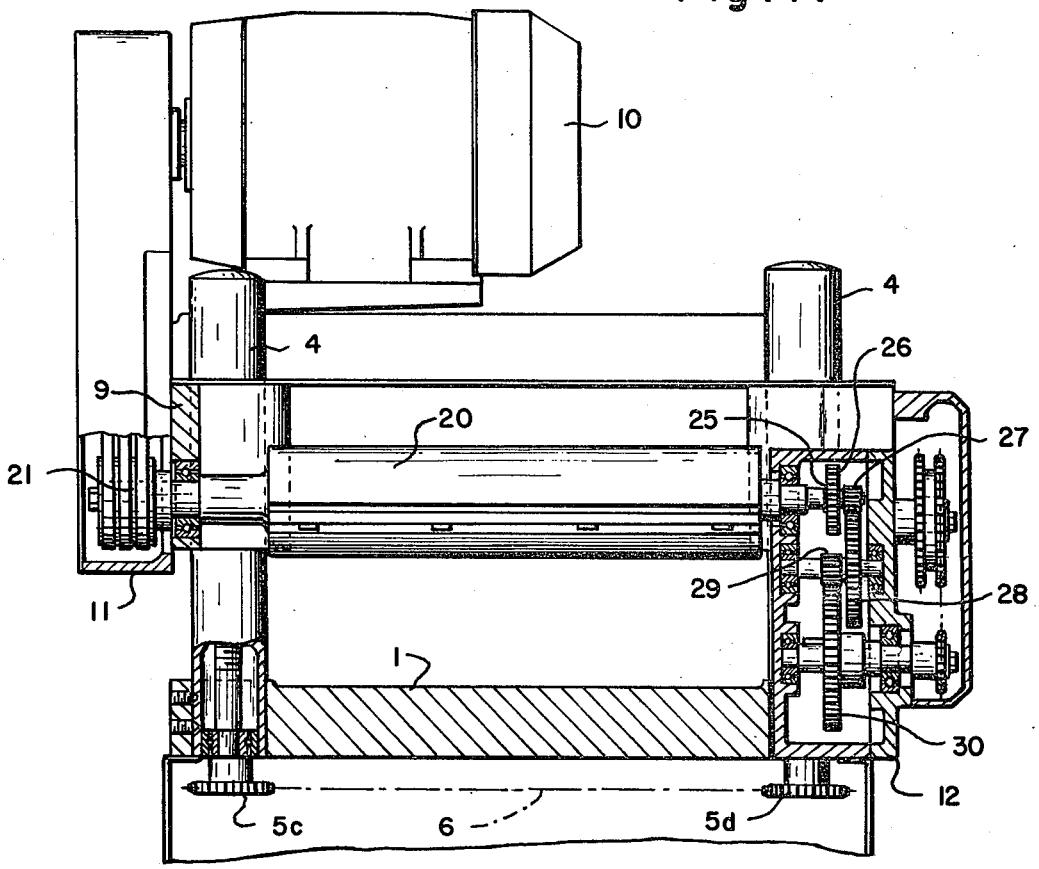
FIG. 7 is an end view of FIG. 5 showing the gearing used to drive the feed rolls and the cutter.
Figure 8:
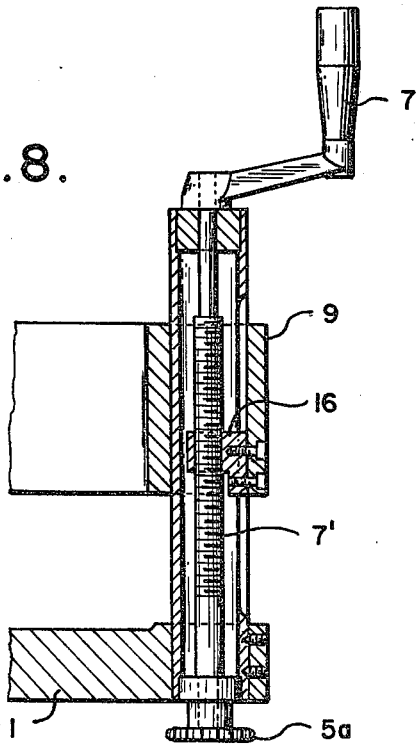
FIG. 8 is a view of the handle that changes the vertical position of the upper housing with parts broken away to show the lug that causes vertical motion when the handle is turned.

Below the bed 1 of the machine, each threaded shaft is provided with a sprocket (*5a, 5b, 5c, 5d* seen in FIG. 4), and an endless chain 6 is passed over each of the sprockets so that rotation of the adjusting handle 7 causes its shaft to rotate, which rotates sprocket *5a* and thus by means of chain 6 and sprockets *5b, 5c, 5d* all the threaded shafts rotate equally in the same direction. In an upper housing 9 the holes through which the threaded shafts 7' extend there are internally threaded lugs 16 which upon rotation of shafts 7' cause vertical movement of housing 9 as shown in FIG. 7.

A chain adjuster 8 is provided to maintain alignment of the threaded shafts.

Figure 5:
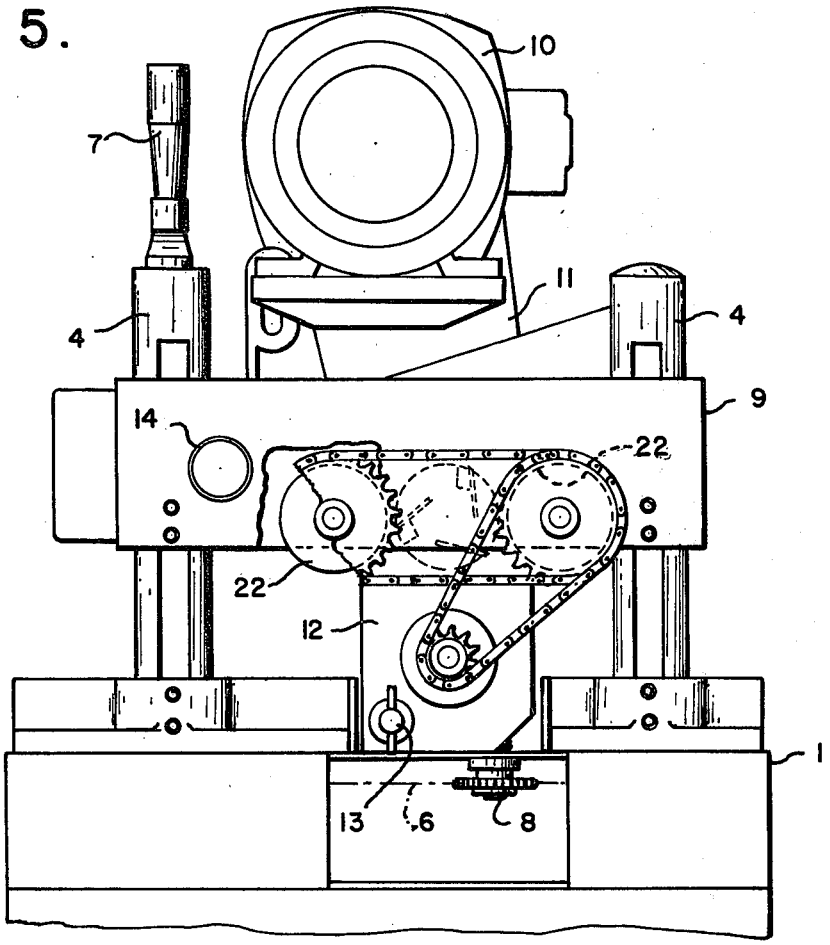
FIG. 5 is a side view of the machine with parts broken away to show certain operating parts.

Slidably mounted on the pillars 4 is an upper housing 9, above which is situated a motor 10. Within the housing 9 is mounted a cylindrical cutter 20 on an axis parallel and transverse to the bed 1 of the machine. The cutter is driven by motor 10 via a single or multiple vee-belt drive 21 housed in the drive casing 11 as shown in FIG. 5.

Figure 6:
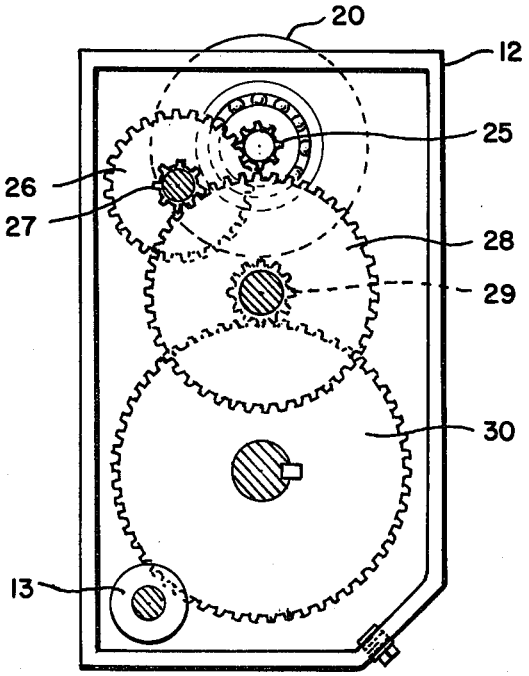
FIG. 6 is an end view with parts broken away to show internal gearing and the vee-belt drive system.

Also mounted in upper housing 9 are a number, preferably two, of feed rollers. These rollers 22 (see FIG. 4) are driven via a reduction gear system, shown in FIG. 6 from the cutter drive 21, the reduction gear being housed in the reduction box 12. More specifically, the gear 25 on the end of the cutter shaft opposite the vee-belts 21 drives gears 26, 27, 28 and 29, the last gear 29 being engaged with the gear 30 that drives feed rolls 22. The feed rollers are mounted on axes parallel and transverse to the bed 1.

The reduction gear 30 for driving the feed rollers is equipped with a disengagement mechanism operated by interrupter lever 13 which can isolate the feed rollers from the motor.

The upper housing 9 is slidably mounted on the four vertical pillars 4 by receiving the pillars closely in bores penetrating the housing. Within the bores, there are formed lugs which each extend through the slot in their respective pillar and threadedly engage the threaded shaft therein.

The lugs are fixed to the upper housing 9, and thus, when the threaded shafts are rotated, the upper housing is raised or lowered depending on the direction of rotation of the shafts.

In this way, the height of the cutter and feed rollers above the bed is varied and the size of the finished product adjusted.

In order to fix the upper housing at any particular height, pinch screws 14 may be provided on one or more pillars to clamp the housing to that or those pillars.

The bed 1 may have idler moles set into it to reduce the friction of the wood as it passes over the bed.

I claim:

1. A thicknessing machine having a plurality of corners for wood comprising, (a) an elongated bed over which the wood passes, (b) an upper housing spaced from said elongated bed, (c) cutter and drive rollers mounted in said upper housing for rotation about separate parallel axes, (d) a plurality of hollow pillars each containing a threaded shaft for adjusting said upper housing, and locating the vertical position of said upper housing on said hollow pillars with respect to said elongated bed.

2. A claim as defined in claim 1 wherein the number of said pillars is 4, one on each corner of the machine.

3. A thicknessing machine as defined in claim 1 wherein said cutter and drive rollers are driven by a motor, a vee-belt takeoff from said motor to said cutter and a reduction gear system connected to the cutter shaft to operate said drive rollers.

4. A thicknessing apparatus as defined in claim 3 wherein means is provided to disengage the drive rollers from the cutter shaft, vee-belt and drive motor.

* * * * *

UNITED STATES PATENT AND TRADEMARK OFFICE

CERTIFICATE OF CORRECTION

PATENT NO. : 4,436,126

DATED : March 13, 1984

INVENTOR(S) : Peter Lawson

It is certified that error appears in the above-identified patent and that said Letters Patent is hereby corrected as shown below:

Please add claim 5 as follows:

--5. A thicknessing machine for wood comprising:

(a) an elongated bed over which the wood passes, said bed being fixed against movement in a vertical direction;

(b) an upper housing vertically spaced from, and movable up and down with respect to, said elongated bed;

(c) a cutter and a drive roller mounted in said upper housing for rotation about separate parallel axes, said cutter and said drive roller being adapted to respectively remove a thickness from wood passing over the bed and to move said wood along said bed past said cutter;

(d) motor means for driving said cutter and said drive roller, said motor means being supported by and being adapted to move up and down with said upper housing, thereby simplifying the driving of said cutter and said drive roller;

UNITED STATES PATENT AND TRADEMARK OFFICE

CERTIFICATE OF CORRECTION

PATENT NO. : 4,436,126

DATED : March 13, 1984

INVENTOR(S) : Peter Lawson

It is certified that error appears in the above-identified patent and that said Letters Patent is hereby corrected as shown below:

(e) four hollow pillars, one being located at each corner of the machine and each containing a threaded shaft, for adjusting the vertical position of said upper housing on said hollow pillars with respect to said elongated bed; and (f) means for so coordinating the movement of said threaded shafts as to cause said upper housing to overall remain in an accurately predetermined relationship relative to said bed as said upper housing is moved up and down relative to said bed.--

On the title page "4 Claims" should read --5 Claims--.

Signed and Sealed this

*Twelfth* Day of *June 1984*

[SEAL]

*Attest:*

GERALD J. MOSSINGHOFF

*Attesting Officer*

*Commissioner of Patents and Trademarks*